US006883469B2

(12) United States Patent
Lu

(10) Patent No.: US 6,883,469 B2
(45) Date of Patent: Apr. 26, 2005

(54) COOLING APPARATUS FOR THE EXTERNAL CONNECTING DUCTS OF ENGINE OIL

(76) Inventor: Chin-Lien Lu, No. 26, Lane 132, Jhuwei N. St, Gangshan Township, Kaohsiung county 820 (TW)

( * ) Notice: Subject to any disclaimer, the term of this patent is extended or adjusted under 35 U.S.C. 154(b) by 0 days.

(21) Appl. No.: 10/720,130

(22) Filed: Nov. 25, 2003

(65) Prior Publication Data

US 2005/0045140 A1 Mar. 3, 2005

(30) Foreign Application Priority Data

Aug. 30, 2003 (TW) ..... 92215806 U

(51) Int. Cl.[7] ..... F01P 9/00
(52) U.S. Cl. ..... 123/41.01
(58) Field of Search ..... 123/41.01, 41.33, 123/41.57, 196 AB

(56) References Cited

U.S. PATENT DOCUMENTS 1,645,134 A * 10/1927 Glasby, Jr. ..... 123/41.33
1,904,407 A * 4/1933 Cappa ..... 123/41.33
2,063,782 A * 12/1936 Barnes ..... 123/196 AB
2,188,172 A * 1/1940 Brehob ..... 123/196 AB
3,232,283 A * 2/1966 Toland ..... 123/41.33

* cited by examiner

*Primary Examiner*—Henry C. Yuen
*Assistant Examiner*—Hyder Ali
(74) *Attorney, Agent, or Firm*—Bacon & Thomas PLLC

(57) ABSTRACT

A cooling apparatus for the external connecting ducts of engine oil includes a metal tubular body having excellent heat conductivity and a crankcase bored with two insert holes in the upper side and a detecting hole in the lower side. The metal tubular body has one end provided with an oil inlet assembled with the detecting hole of the crankcase and the other end provided with two oil outlets respectively assembled with the two insert holes of the crankcase. The metal tubular body has its intermediate curved part installed near one side of an engine fan, so that the metal tubular body together with the machine oil inside can be cooled by the forceful wind of the engine fan, able to lower the temperature of the machine oil in the crankcase. The cooling apparatus elevates lubricating effect to machine parts and prolongs service life of an engine.

3 Claims, 4 Drawing Sheets

COOLING APPARATUS FOR THE EXTERNAL CONNECTING DUCTS OF ENGINE OIL

BACKGROUND OF THE INVENTION

1. Field of the Invention

This invention relates to a cooling apparatus for the external connecting ducts of engine oil, particularly to one provided with a metal tubular body to guide machine oil to flow therethrough, and then the metal tubular body and the machine oil inside are cooled by the forceful wind of an engine fan, able to lower the temperature of the machine oil therein.

2. Description of the Prior Art

As commonly known, machine oil is employed to adhere to the surfaces of machine parts. If the temperature of the machine oil is excessively high, the viscosity of the machine oil will be lowered, thus not only resulting in wear to the machine parts but also causing damage to an engine (A) due to excessively high temperature produced by friction between the machine parts. Therefore, machine oil has to be maintained at a proper temperature so as to enable the engine (A) to operate normally.

A conventional crankcase 1, as shown in FIGS. 1 and 2, includes a housing (A1), a cover (A2) covered on the housing (A1) and a detecting hole 10 in the lower side. The structure of the conventional crankcase 1 only lays stress on the circulatory lubrication of machine oil, but pays no attention to cooling of machine oil inside. The conventional crankcase 1 has its shell cooled by external air, but the machine parts rotating inside the crankcase 1 cannot get their heat dispersed. Therefore, additionally installing a cooling apparatus for machine oil is a most direct method to enhance lubrication effect between machine parts and prolong their service life. A water-cooling apparatus has been developed for foresaid purpose, but it may cost much expense to additionally install such a water-cooling apparatus and also may spoil the integral combination of the engine (A).

SUMMARY OF THE INVENTION

The objective of the invention is to offer a cooling apparatus for the external connecting ducts of engine oil, able to lower the temperature of the machine oil in a crankcase and prolong the service life of machine parts in the crankcase.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
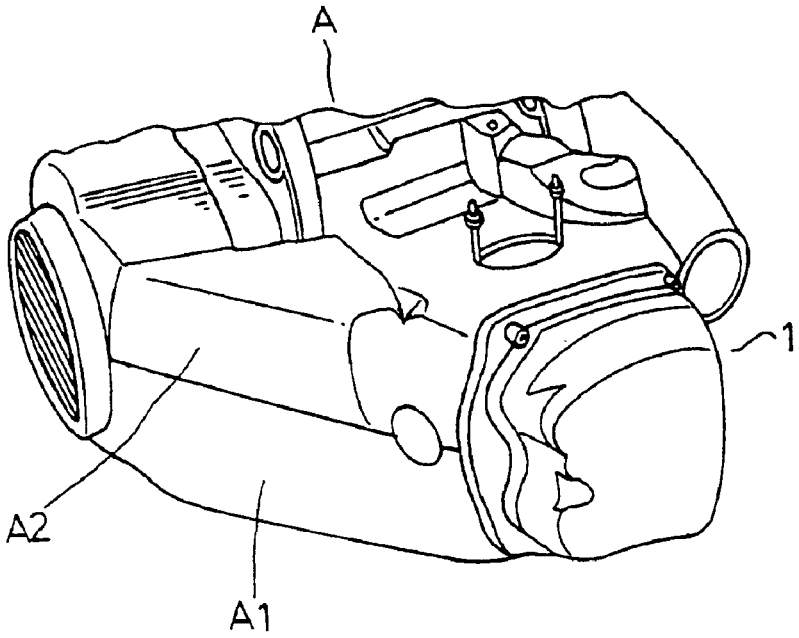
FIG. 1 (PRIOR ART)
FIG. 1 is a perspective view of a conventional engine.
Figure 2:
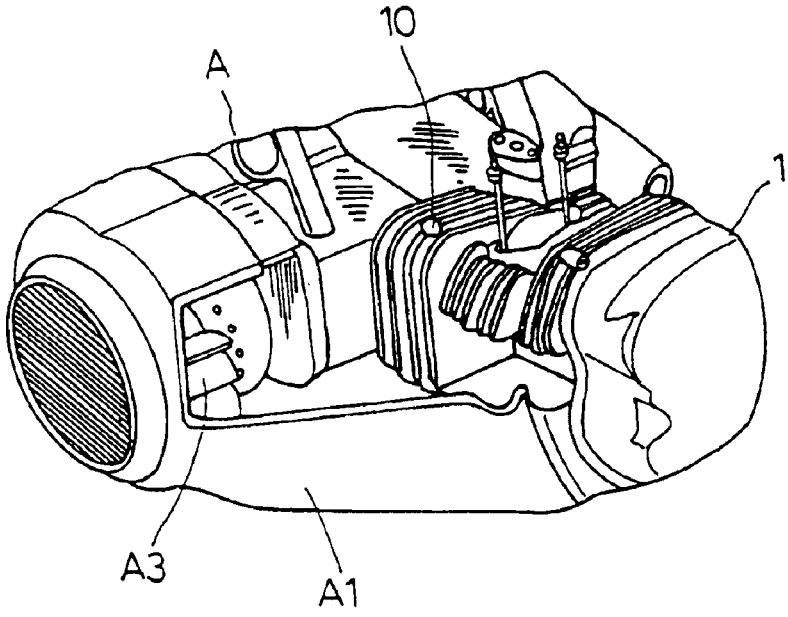
FIG. 2 (PRIOR ART)
FIG. 2 is a perspective and cross-sectional view of the conventional engine.
Figure 3:
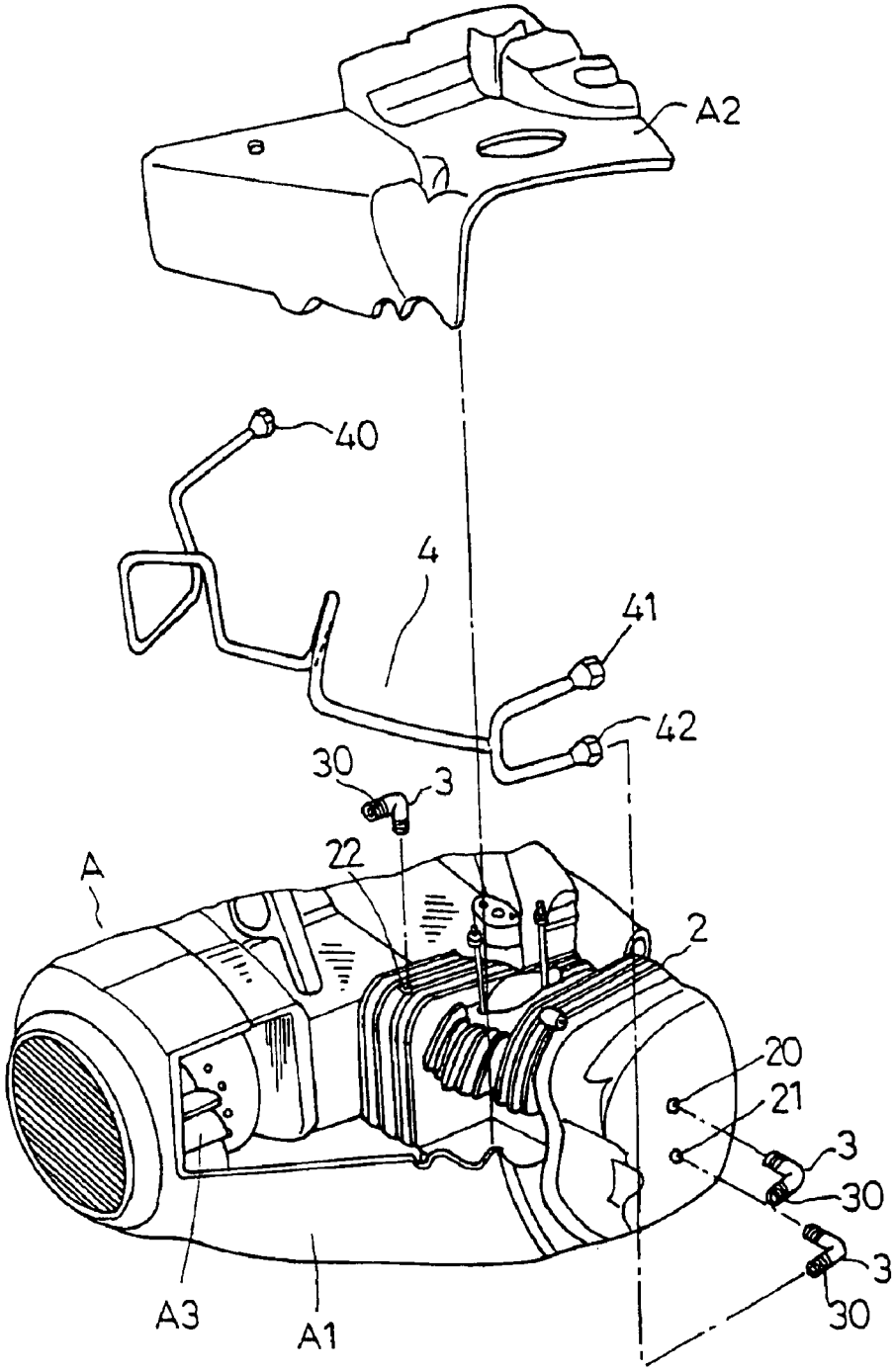
FIG. 3 is an exploded perspective view of a cooling apparatus for the external connecting ducts of engine oil in the present invention.
Figure 4:
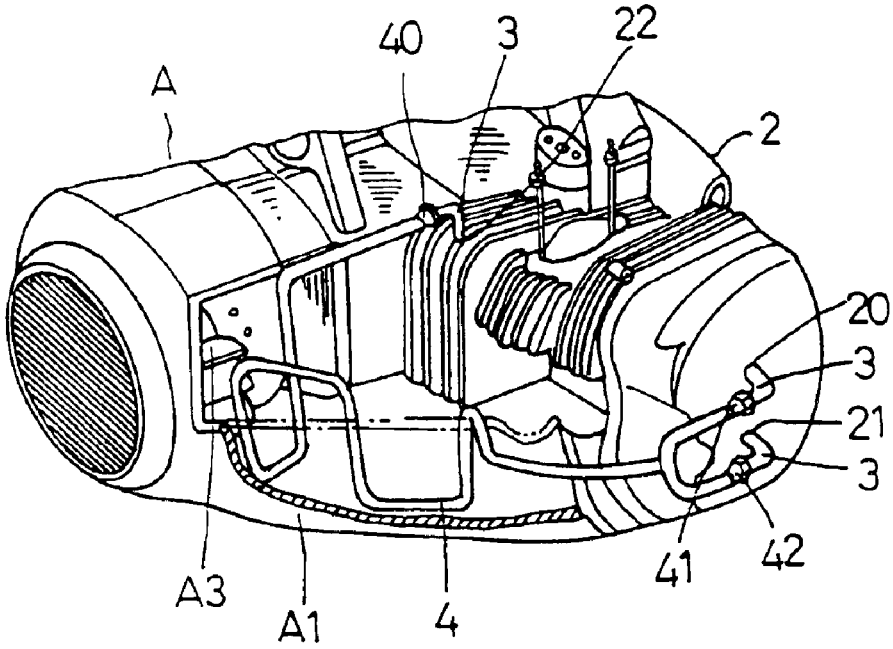
FIG. 4 is a perspective and cross-sectional view of the cooling apparatus for the external connecting ducts of engine oil in the present invention.
Figure 5:
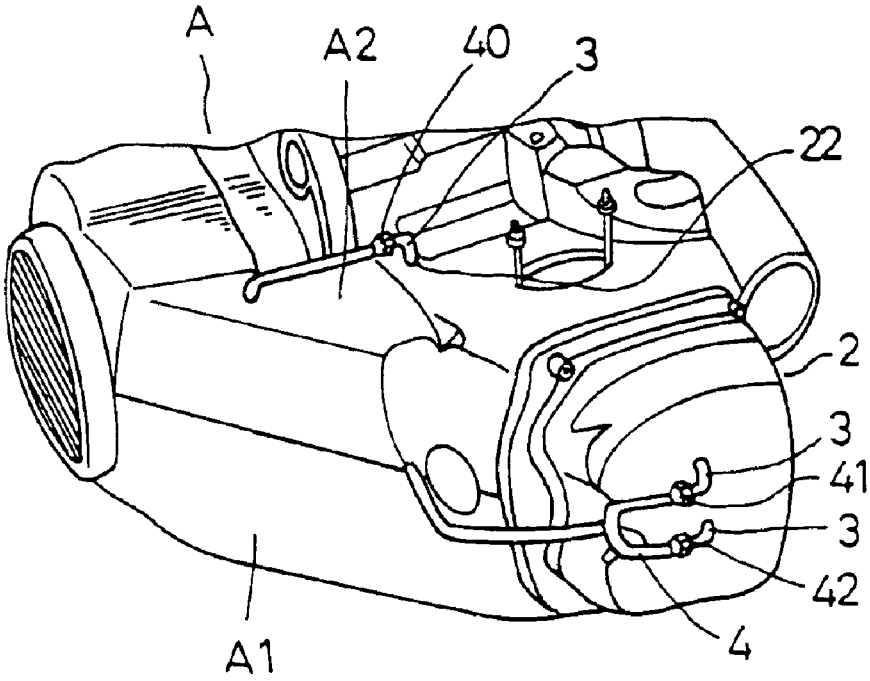
FIG. 5 is a perspective and cross-sectional view of the cooling apparatus for the external connecting ducts of engine oil in a using condition in the present invention.

A preferred embodiment of a cooling apparatus for the external connecting ducts of engine oil in the present invention, as shown in FIGS. 3, 4 and 5, includes an engine (A), a housing (A1), a cover (A2), an engine fan (A3), a crankcase 2, plural elbows 3 and a curved metal tubular body 4 combined together.

The crankcase 2 is positioned at one side of the engine (A), having two insert holes 20, 21 in the upper side and a detecting hole 22 in the lower side. The elbows 3 respectively having both ends formed with threads 30 are respectively screwed with the insert hole 20, 21 and the detecting hole 22 of the crankcase 2. The metal tubular body 4 has one end provided with an adapter 40 and the other end provided with two adapters 41, 42 to be respectively assembled with the elbows 3. The curved metal tubular body 4 is installed in the housing (A1) at one side of the engine fan (A3), as shown in FIG. 4.

In assembling, firstly, the elbows 3 are respectively screwed with the insert holes 20, 21 and the detecting hole 22 of the crankcase 2. Next, the metal tubular body 4 has its adapter 40 screwed with the threads 30 of the elbow 3 on the detecting hole 22, and its adapters 41, 42 respectively screwed with the threads 30 of the elbows 3 on the insert hole 20, 21 of the crankcase 2. Lastly, the cover (A2) is covered on the crankcase 2 to finish assembly of a cooling apparatus.

In using, when the engine (A) is started, the high-temperature lubricating machine oil in the crankcase 2 will flow into the curved metal tubular body 4 through the detecting hole 22 at the lower side of the crankcase 2. Then, the curved and long metal tubular body 4 together with the machine oil inside is cooled by the forceful wind of the engine fan (A3). After the temperature of the machine oil inside the metal tubular body 4 is properly dropped, the machine oil will spout into the crankcase 2 through the insert holes 20, 21, thus able to lower the temperature of the machine oil in the crankcase 2 and maintain its excellent lubrication effect.

As can be noted from the above description, this invention has the following advantages.

1. The cooling apparatus of the present invention is installed near one side of the engine fan (A3) of a motorcycle; therefore the forceful wind of the engine fan (A3) can directly make the metal tubular body 4 cooled and heat dispersed to lower the temperature of the machine oil inside.

2. The cooling apparatus of the present invention can be manufactured and installed with ease, not increasing much burden to a motorcycle.

3. The cooling apparatus of the present invention is directly installed on the crankcase 2, unnecessary to have the crankcase 2 modified greatly and impossible to spoil the integral outer beauty of a motorcycle.

4. The cooling apparatus of the present invention is much lower than the conventional water-cooling apparatus in its assembly cost, giving the same effect of lowering the temperature of the machine oil in the crankcase 2.

While the preferred embodiment of the invention has been described above, it will be recognized and understood that various modifications may be made therein and the appended claims are intended to cover all such modifications that may fall within the spirit and scope of the invention.

What is claimed is:

1. A cooling apparatus for the internal connecting ducts of engine oil comprising:

A crankcase bored with insert holes in an upper side, said crankcase bored with a detecting hole in the lower side:

Plural elbows respectively screwed with said insert holes and said detecting hole of said crankcase:

A curved metal tubular body provided with a adapter at one end and two adapters at the other end, said adapters of said metal tubular body respectively screwed with said elbows: and Said curved metal tubular body installed beside an engine fan in said crankcase, high-temperature machine oil inside said crankcase flowing into said curved metal tubular body, the forceful wind of said engine fan cooling said metal tubular body to lower the temperature of said machine oil therein, said machine oil in said metal tubular body then spouting into said crankcase through said insert holes in the upper side, said cooling apparatus able to lower the temperature of said machine oil and maintain excellent lubrication and viscosity of said machine oil to protect the machine parts in said crankcase.

2. The cooling apparatus for the external connecting ducts of engine oil as claimed in claim 1, wherein said crankcase is bored with two insert holes in the upper side, and said metal tubular body has one end provided with two adapters to be respectively assembled with said two insert holes of said crankcase by means of said elbows.

3. The cooling apparatus for the external connecting ducts of engine oil as claimed in claim 1, wherein said curved metal tubular body is installed in the space abutting one side of said engine fan, so that when said engine is started, the forceful wind of said engine fan can cool the metal tubular body and lower the temperature of the machine oil therein to maintain excellent lubrication effect of said machine oil.

* * * * *